US010532365B2

(12) United States Patent
Eliasson

(10) Patent No.: US 10,532,365 B2
(45) Date of Patent: Jan. 14, 2020

(54) CENTRIFUGAL SEPARATOR HAVING AN OUTLET OPENING OPPOSITE A STACK OF SEPARATION DISKS

(71) Applicant: ALFA LAVAL CORPORATE AB, Lund (SE)

(72) Inventor: Thomas Eliasson, Älvsjö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 591 days.

(21) Appl. No.: 15/305,277

(22) PCT Filed: Apr. 30, 2015

(86) PCT No.: PCT/EP2015/059451
§ 371 (c)(1),
(2) Date: Oct. 19, 2016

(87) PCT Pub. No.: WO2015/166020
PCT Pub. Date: Nov. 5, 2015

(65) Prior Publication Data

US 2017/0036220 A1 Feb. 9, 2017

(30) Foreign Application Priority Data

Apr. 30, 2014 (EP) ..... 14166549

(51) Int. Cl.
*B04B 5/08* (2006.01)
*B04B 7/04* (2006.01)
(Continued)

(52) U.S. Cl.
CPC ..... *B04B 5/08* (2013.01); *B04B 5/12* (2013.01); *B04B 7/04* (2013.01); *B04B 7/14* (2013.01);
(Continued)

(58) Field of Classification Search
CPC .. B04B 5/08; B04B 11/02; B04B 5/12; B04B 7/14; B04B 7/04; B04B 2005/125; F01M 13/04; F01M 2013/0422
(Continued)

(56) References Cited

U.S. PATENT DOCUMENTS 3,234,716 A 2/1966 Sevin et al.
4,087,924 A * 5/1978 Fujimoro ..... F26B 5/08 34/58
(Continued)

FOREIGN PATENT DOCUMENTS

CN 1961139 A 5/2007
CN 101203319 A 6/2008
(Continued)

OTHER PUBLICATIONS

JP 59171338 Claims ProQuest Machine Translation (Year: 1984).*
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator for cleaning gas containing liquid impurities includes a stationary casing, enclosing a separation space through which a gas flow is permitted. The stationary casing includes a surrounding side wall, a first end wall and a second end wall. An inlet extends through the stationary casing and permits supply of the gas to be cleaned. A rotating member includes a stack of separation disks rotatable around an axis of rotation. A drive member rotates the rotating member. A gas outlet permits discharge of cleaned gas, and includes an outlet opening through the side wall. A drainage outlet permits discharge of liquid
(Continued)

impurities separated from the gas. The outlet opening is positioned opposite to the stack of separation disks.

17 Claims, 5 Drawing Sheets

(51) Int. Cl.
*F01M 13/04* (2006.01)
*B04B 7/14* (2006.01)
*B04B 5/12* (2006.01)
*B04B 11/02* (2006.01)

(52) U.S. Cl.
CPC ..... *B04B 11/02* (2013.01); *F01M 13/04* (2013.01); *B04B 2005/125* (2013.01); *F01M 2013/0422* (2013.01)

(58) Field of Classification Search
USPC ..... 494/67, 68, 70, 72, 74; 123/41.86; 55/385.3, 451; 95/269, 270; 96/216
See application file for complete search history.

(56) References Cited

U.S. PATENT DOCUMENTS

| | | | | |
|---|---|---|---|---|
| 7,992,551 | B2 | 8/2011 | Shieh | |
| 9,031,768 | B2 * | 5/2015 | Lagerlof | B01D 45/14 701/114 |
| 2006/0142135 | A1 | 6/2006 | Hallgren et al. | |
| 2009/0000258 | A1 | 1/2009 | Carlsson et al. | |
| 2009/0025562 | A1 | 1/2009 | Hallgren et al. | |
| 2009/0025563 | A1 | 1/2009 | Borgstrom et al. | |
| 2010/0011723 | A1 | 1/2010 | Szepessy et al. | |
| 2011/0011380 | A1 | 1/2011 | Lagerlöf et al. | |
| 2011/0281712 | A1 | 11/2011 | Schlamann et al. | |
| 2014/0051563 | A1 | 2/2014 | Mackel et al. | |

FOREIGN PATENT DOCUMENTS

| | | | |
|---|---|---|---|
| CN | 101384329 | A | 3/2009 |
| CN | 101970814 | A | 2/2011 |
| CN | 102470378 | A | 5/2012 |
| CN | 102821866 | A | 12/2012 |
| CN | 103097674 | A | 5/2013 |
| CN | 103153474 | A | 6/2013 |
| DE | 102008033638 | A1 | 2/2009 |
| EP | 2584160 | A1 | 4/2013 |
| JP | 52-135453 | A | 11/1977 |
| JP | 56-24960 | U | 7/1979 |
| JP | 59-171338 | U | 11/1984 |
| JP | 59171338 | * | 11/1984 |
| JP | 3-86051 | U | 8/1991 |
| JP | 9-512311 | A | 12/1997 |
| JP | 2008-543535 | A | 12/2008 |
| JP | 2009-526631 | A | 7/2009 |
| JP | 2009-526645 | A | 7/2009 |
| JP | 2010-142807 | A | 7/2010 |
| JP | 2011-515612 | A | 5/2011 |
| JP | 2011-528280 | A | 11/2011 |
| WO | WO 95/29291 | A1 | 11/1995 |
| WO | 2005087384 | A1 | 9/2005 |
| WO | WO 2005/119020 | A1 | 12/2005 |
| WO | WO 2006/132577 | A1 | 12/2006 |
| WO | 2007094725 | A1 | 8/2007 |
| WO | 2009108046 | A1 | 9/2009 |
| WO | WO 2009/116897 | A1 | 9/2009 |
| WO | 2011005160 | A1 | 1/2011 |
| WO | WO 2011/126436 | A1 | 10/2011 |
| WO | 2012036796 | A1 | 3/2012 |
| WO | WO 2012/035089 | A1 | 3/2012 |
| WO | 2012152925 | A2 | 11/2012 |
| WO | 2013067245 | A1 | 5/2013 |

OTHER PUBLICATIONS

International Search Report and Written Opinion issued in corresponding PCT Application No. PCT/EP2015/059451, dated Jul. 17, 2015, pp. 1-9.
English translation of the Japanese Notice of Reasons for Rejection, dated Nov. 20, 2017, for Japanese Application No. 2016-565259.
International Search Report and Written Opinion of the International Searching Authority (Forms PCT/ISA/237 and PCT/ISA/210), dated Jul. 17, 2015, for International Application No. PCT/EP2015/059457.
English translation of the Japanese Decision of Rejection for Japanese Application No. 2016-565259, dated Mar. 4, 2019.
English translation of the Japanese Decision to Reject the Amendments for Japanese Application No. 2016-565259, dated Mar. 4, 2019.
English translation of a Chinese Search Report for Chinese Application No. 201580023608.9, dated Feb. 2, 2018.
English translation of a Japanese Notice of Reasons for Rejection for Japanese Application No. 2016-565233, dated Jan. 29, 2018.

* cited by examiner

CENTRIFUGAL SEPARATOR HAVING AN OUTLET OPENING OPPOSITE A STACK OF SEPARATION DISKS

CROSS REFERENCE TO RELATED APPLICATIONS

This application is a National Stage Application of and claims priority to PCT Application No. PCT/EP2015/059451, filed on Apr. 30, 2015, which is a PCT Application of and claims priority to EP Application No. 14166549.7, filed on Apr. 30, 2014, the subject matter of which applications is incorporated by reference herein in their entirety. This application is also related to Ser. No. 15/305,290 which is concurrently being filed on even date of the present application, which claims priority to PCT Application No. PCT/EP2015/059457, filed on Apr. 30, 2015, which is a PCT Application of and claims priority to EP Application No. 14166551.3, filed on Apr. 30, 2014.

TECHNICAL FIELD

The present invention refers to a centrifugal separator for cleaning gases containing liquid impurities. In particular, the centrifugal separator according to the invention is configured for cleaning oil particles from crankcase gases of a combustion engine, the centrifugal separator having an outlet opening opposite a stack of separation disks.

BACKGROUND

WO 2007/094725 discloses a centrifugal separator having a gas inlet that extends through the bottom of the centrifugal separator. The outlet opening of the gas outlet is provided through the side wall above the stack of separating disks adjacent to an upper one of the end walls.

WO 2005/087384 discloses a centrifugal separator having a gas inlet that extends through the top of the centrifugal separator. The outlet opening of the gas outlet is provided through the side wall below the stack of separating disks adjacent to a lower one of the end walls.

US 2011/0281712 discloses a centrifugal separator for cleaning crankcase gases having an outlet opening of the gas outlet that extends through an upper end wall of the centrifugal separator. An inlet opening of the gas inlet extends through the lower end wall.

One problem of the prior art centrifugal separators is that they have a relatively large size requiring a large space. This is a significant problem, especially when the centrifugal separator is used for cleaning crankcase gases from smaller combustion engines, preferably from smaller diesel engines, to be used especially in lighter trucks and the like.

One way of reducing the size of the centrifugal separator is to reduce the diameter of the stack of separation disks. However, in order to maintain the separation efficiency, the height or the length of the stack then has to be increased.

SUMMARY

The object of the present invention is to remedy to the problem discussed above, and more precisely to provide a centrifugal separator having a reduced or compact size while maintaining or improving the separation efficiency.

This object is achieved by the centrifugal separator initially defined, which has an outlet opening positioned opposite to the stack of separation disks.

By providing the outlet opening through the side wall opposite, or just opposite, to the stack of separation disks, it is possible to reduce the height of the centrifugal separator. There is no need for any gas outlet channels or gas outlet space above or below the separation space due to the gas outlet. A compact design, suitable for being mounted to a combustion engine, is thus achieved.

Furthermore, this position of the outlet opening is advantageous due to the fact that the distance from the stack of separation disks to the outlet opening is short. This distance may also be the same for each gap formed between adjacent separation disks to the outlet opening, contributing to a uniform gas flow.

Still further, the cleaned gas will be conveyed out of the separation space without circulating several rounds around the stack of separation disks, which decrease the risk of re-mixing of the cleaned gas and the separated liquid particles, especially in case of small liquid impurities existing in crankcase gases of modern diesel engines.

Still further, the position of the outlet opening is advantageous, since it permits the gas to be discharged from the centrifugal separator at a position where the gas pressure has it maximum. The pumping capability of the centrifugal separator thus is improved.

According to an embodiment of the invention, the outlet opening has an elongated shape along a longitudinal axis. Such an opening with an elongated shape, or in the form of a slot, through the side wall of the casing, is advantageous since it permits a uniform distribution of the flow of gas over a large area.

According to a further embodiment of the invention, the longitudinal axis has at least a major component of direction which is parallel with the axis of rotation. Such an extension of the elongated outlet opening, or the slot, contributes further to permits distribution of the flow of gas over a large area in relation to the axial length of the stack of separation disks.

According to a further embodiment of the invention, the longitudinal axis is substantially parallel, or parallel, with the axis of rotation.

According to a further embodiment of the invention, the stack of separation disks has an outer circumferential periphery and an axial length at the outer circumferential periphery, wherein the outlet opening along the longitudinal direction has a length, wherein the length is 80-130% of the axial length. This feature contributes further to a uniform gas flow through the whole stack of separation disks, i.e. to an equal gas flow in each of the gaps between adjacent separation disks.

According to a further embodiment of the invention, the length is 90-120% of the axial length. Advantageously, the length may be 100-110% of the axial length.

According to a further embodiment of the invention, the stationary casing has a radius R from the axis of rotation to the surrounding side wall. The surrounding side wall thus has a circular cross section, at least with a major part of the circumference of the side wall.

According to a further embodiment of the invention, the gas outlet has an upstream portion extending from the outlet opening in an outlet direction, which extends through an upstream point of the outlet opening and is parallel with a transversal line extending through the axis of rotation, wherein the perpendicular distance between the outlet direction and said transversal line is at least 0.8R and at the most 1.2R, especially with respect to the radius R opposite to the outlet opening. Such an extension of the outlet direction decreases the flow resistance for the gas flow exiting the separation space.

According to a further embodiment of the invention, the perpendicular distance between the outlet direction and said line is at least 0.9R and at the most 1.1R.

According to a further embodiment of the invention, the perpendicular distance between the outlet direction and said line is substantially equal, or equal, to the radius R. Such an extension of the outlet direction results in a minimum flow resistance for the gas flow leaving the separation space.

According to a further embodiment of the invention, the gas outlet has a downstream portion, which is provided downstream the upstream portion and has an increasing cross-section. Such an increasing cross-section is fluid dynamically advantageous by permitting recovery of the pressure drop at the outlet opening. Advantageously, the upstream portion may have a constant cross-section.

According to a further embodiment of the invention, the downstream portion extends from the upstream portion. Thus, the downstream portion may start directly where the upstream portion ends.

According to a further embodiment of the invention, the gas outlet is configured to convey the liquid impurities to the drainage outlet.

According to a further embodiment of the invention, the drainage outlet is provided downstream the downstream portion.

According to a further embodiment of the invention, the separation disks are provided at a distance from each other to form a gap between adjacent separation disks. Advantageously, each gap may be positioned opposite, or just opposite, the outlet opening.

According to a further embodiment of the invention, the rotating member defines a central space, which is connected to the inlet and configured to convey the gas to be cleaned from the inlet to the gaps of the stack of separation disks.

BRIEF DESCRIPTION OF THE DRAWINGS

The invention is now to be explained more closely through a description of various embodiments and with reference to the drawings attached hereto.

DETAILED DESCRIPTION

Figure 1:
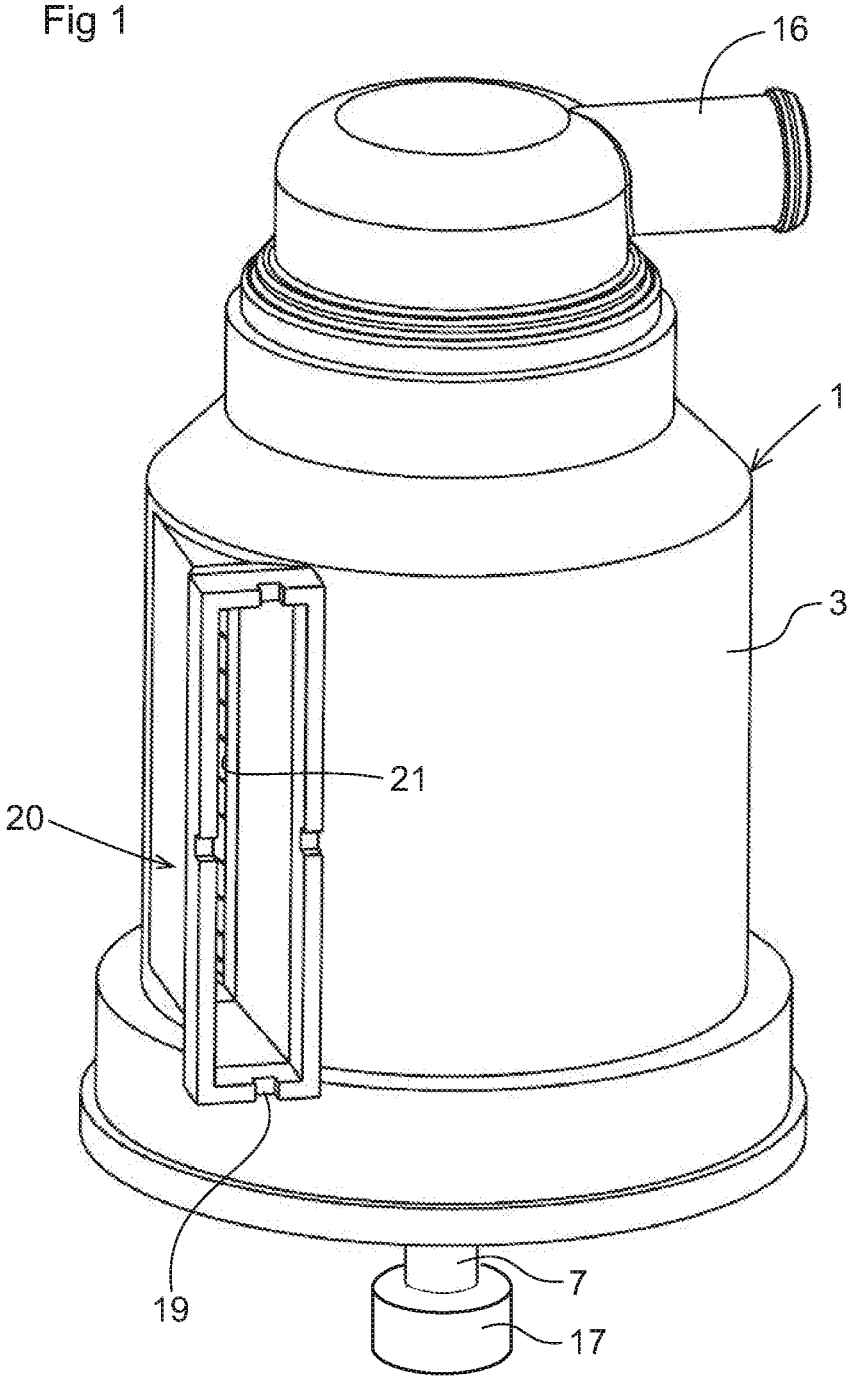
FIG. 1 discloses a perspective view of a centrifugal separator according to a first embodiment of the invention.

FIGS. 1 to 5 disclose a first embodiment of a centrifugal separator for cleaning gases containing liquid impurities, especially crankcase gases of a combustion engine, which contain liquid impurities in the form of oil droplets and/or oil mist.

The centrifugal separator includes a stationary casing 1, which is configured to be mounted to a combustion engine (not shown), especially a diesel engine, at a suitable position, such as on top of the combustion engine or at the side of the combustion engine.

It is to be noted that the centrifugal separator is also suitable for cleaning gases from other sources than combustion engines, for instance the environment of machine tools which frequently contains large amounts of liquid impurities in the form of oil droplets or oil mist.

The stationary casing 1 encloses a separation space 2 through which a gas flow is permitted. The stationary casing 1 comprises, or is formed by, a surrounding side wall 3, a first end wall 4 (in the embodiments disclosed an upper end wall) and a second end wall 5 (in the embodiments disclosed a lower end wall).

Figure 4:
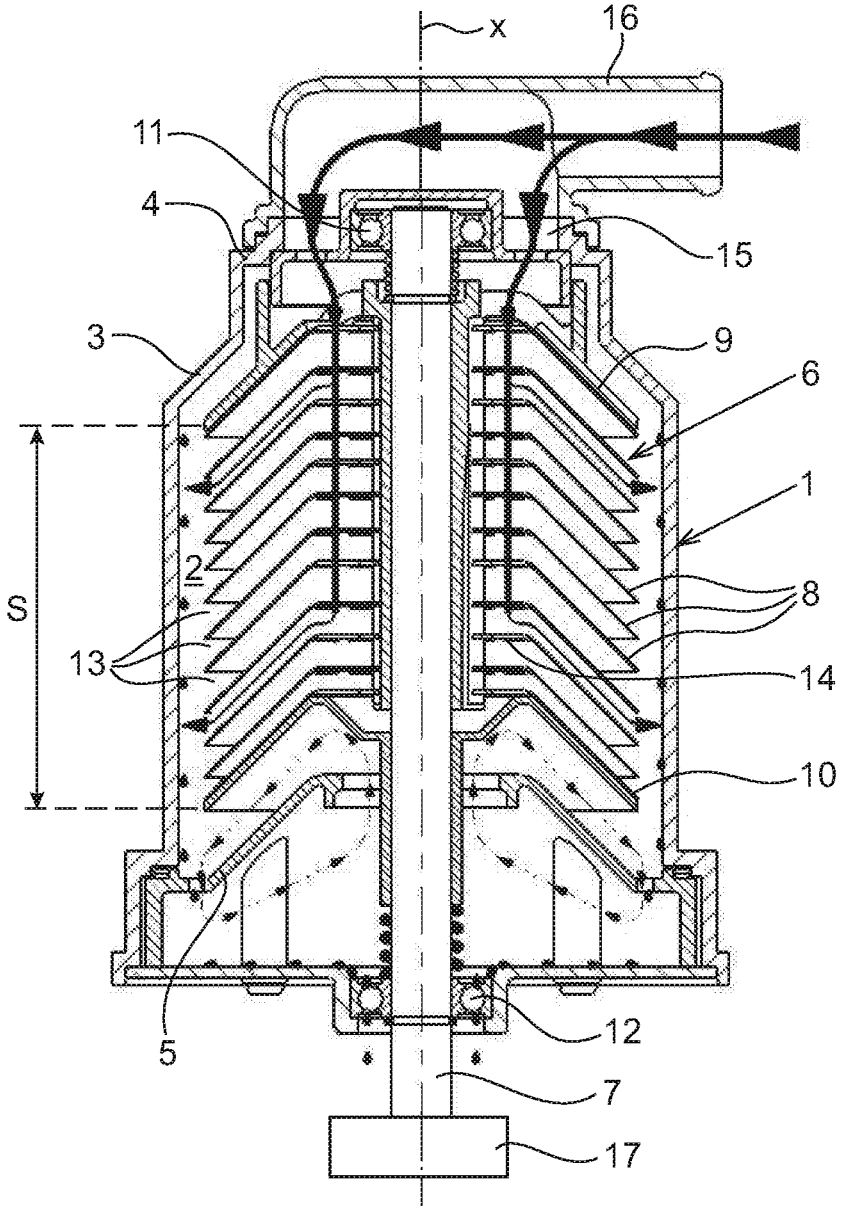
FIG. 4 discloses a sectional view along the line IV-IV in FIG. 2.
Figure 5:
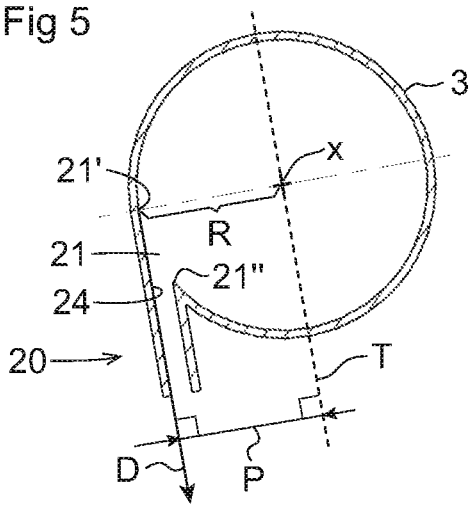
FIG. 5 illustrates the direction of a gas outlet of the centrifugal separator in FIG. 1.

The centrifugal separator includes a rotating member 6, see FIG. 4, which is arranged to rotate around an axis x of rotation. It should be noted that the stationary casing 1 is stationary in relation to the rotating member 6, and preferably in relation to the combustion engine to which it may be mounted.

The stationary casing 1 has a radius R from the axis x of rotation to the surrounding side wall 3, which is constant at least with respect to a major part of the circumference of the surrounding side wall 3. The surrounding side wall 3 thus has a circular, or substantially, circular cross-section.

The rotating member 6 comprises a spindle 7 and a stack of separation disks 8 attached to the spindle 7. All the separation disks 8 of the stack of separation disks 8 are provided between a first end plate 9 (in the embodiments disclosed an upper end plate) and a second end plate 10 (in the embodiments disclosed a lower end plate), see FIG. 4.

The spindle 7, and thus the rotating member 6, is rotatably supported in the stationary casing 1 by means of a first bearing 11 (in the embodiments disclosed an upper bearing) and a second bearing 12 (in the embodiments disclosed a lower bearing), see FIG. 4.

The separation disks 8 are conical and extend downwardly and outwardly from the spindle 7. It should be noted that the separation disks 8 could also extend upwardly and outwardly, or even radially. The separation disks 8 are provided at a distance from each other by means of distance members (not shown) in order to form gaps 13 between adjacent separation disks 8, i.e. a gap 13 between each pair of adjacent separation disks 8. The axial thickness of each gap 13 may be in the order of 1-2 mm, for instance.

The separation disk 8 may be made of plastics or metal. The number of separation disks 8 is normally higher than indicated in FIG. 4 and may be for instance 50 to 100 separation disks 8 depending of the size of the centrifugal separator.

The rotating member 6 defines a central space 14. The central space 14 may be formed by a hole in each of the separation disks 8. In the embodiments disclosed the central space 14 is formed by a plurality of holes, see FIG. 2, each extending through the first end plate 9 and through each of the separation disks 8.

The centrifugal separator comprises an inlet 15 for the supply of the gas to be cleaned. The inlet 15 extends through the stationary casing 1, and more precisely through the first end wall 4. The inlet 15 communicates with the central space 14 so that the gas to be cleaned is conveyed from the inlet 15 via the central space 14 to the gaps 13 of the stack of separation disks 8, see FIG. 4.

The inlet 15 is configured to communicate with the crankcase of the combustion engine, or any other source, via an inlet conduit 16 permitting the supply of crankcase gas from the crankcase to the inlet 15 and further to the central space 14 and the gaps 13 as explained above.

The centrifugal separator comprises a schematically disclosed drive member 17 for rotating the rotating member 6. The drive member 17 may comprise a turbine wheel, see WO2012/152925, rotated by means of an oil jet from the oil system of the combustion engine, or a free jet wheel comprising a blow-back disk, see WO2014/023592, wherein the free jet is provided by the oil system of the combustion engine. Alternatively, the drive member 17 may be independent of the combustion engine and comprise an electric motor, a hydraulic motor or a pneumatic motor.

The centrifugal separator comprises a drainage outlet 19 configured to permit discharge of liquid impurities separated from the gas and a gas outlet 20 configured to permit discharge of cleaned gas. The liquid impurities of the gas will be separated from the gas in the gaps 13, and the cleaned gas will be conveyed out of the gaps 13 to the separation space 2 and further to the gas outlet 20.

The gas outlet 20 comprises an outlet opening 21 in the side wall 3. The outlet opening 21 is elongated and configured as a slot through the side wall 3 of the stationary casing 1. The outlet opening 21 has an upstream point 21', or upstream axial line, and a downstream point 21", or downstream axial line, see FIGS. 2 and 5. In the first embodiment, the upstream point 21' and the downstream point are located at the radius R from the axis x of rotation.

Figure 3:
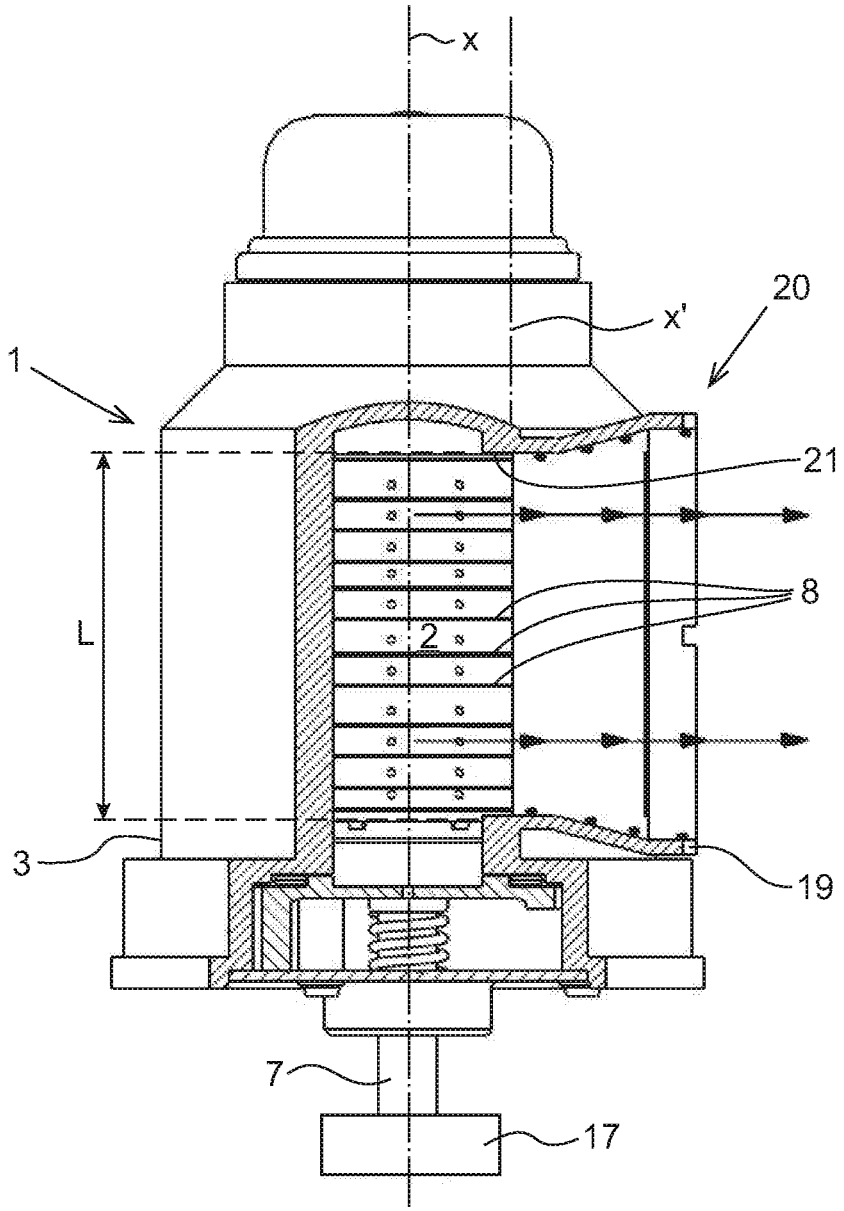
FIG. 3 discloses a sectional view along the line III-III in FIG. 2.

Thus, the outlet opening 21 has an elongated shape along a longitudinal axis x'. In the embodiments disclosed, the longitudinal axis x' is parallel or substantially parallel with the axis x of rotation as can be seen in FIG. 3. However, it is to be noted that the longitudinal axis x', i.e. the extension of the inlet opening 21, may slope slightly to the axis x of rotation. In other words, the longitudinal axis x' may have a major component of direction which is parallel with the axis x of rotation, and in that case a minor component of direction, which is perpendicular to the axis x of rotation (not shown).

The outlet opening, or slot, 21, is positioned opposite, or just opposite, to the stack of separation disks 8. Thus, the outlet opening 21 is thus positioned laterally beside the stack of separation disks 8, which means that the distance from the gaps 13 to the outlet opening 21 is short, and may be the same for each gap 13 to the outlet opening 21.

The stack of separation disks 8 has an outer circumferential periphery and an axial length S at the outer circumferential periphery, see FIG. 4. The outlet opening 21 has a length L along the longitudinal axis x', see FIG. 3. The length L is 80-130% of the axial length S, preferably 90-120% of the axial length S, and more preferably 100-110% of the axial length S. In particular, the length L may be at least equal to, or correspond to the axial length S, or be in the same order as the axial length S. If the length L is at least equal to the axial length S, an equal distance from each gap 13 to the outlet opening 21 may be ensured.

Figure 2:
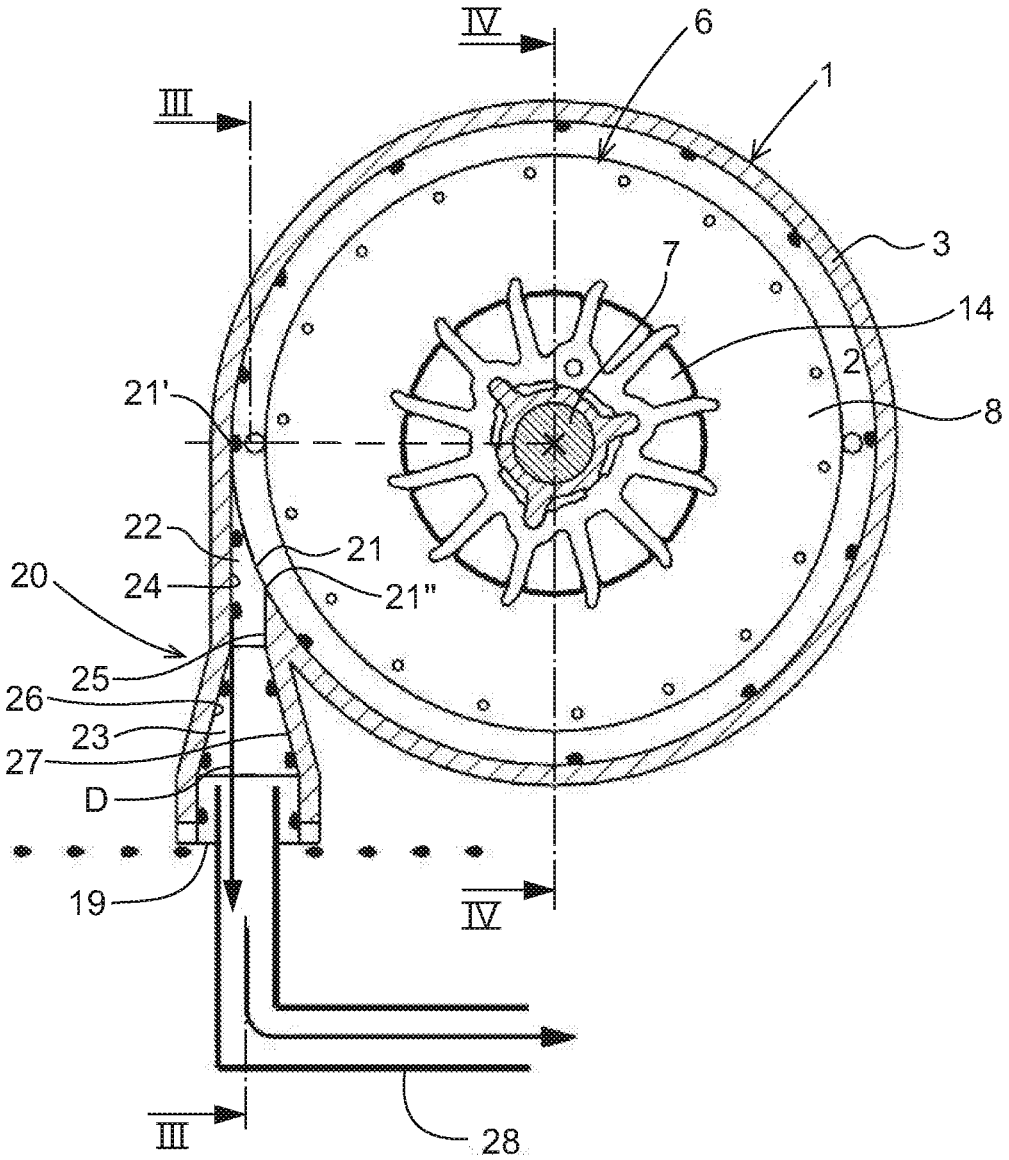
FIG. 2 discloses a cross-sectional view perpendicular to an axis of rotation of the centrifugal separator in FIG. 1.

The gas outlet 20 has an upstream portion 22 and a downstream portion 23, see FIG. 2. The upstream portion 22 extends from, or starts at, the outlet opening 21. At least the upstream portion 22 extends in an outlet direction D as can be seen in FIG. 2.

The outlet direction D extends through an upstream point 21' of the outlet opening 21 and is parallel with a transversal line T extending through the axis x of rotation. The perpendicular distance P between the outlet direction D and the transversal line T is at least 0.8R and at the most 1.2R.

In the embodiments disclosed in FIGS. 1-5, the perpendicular distance between the outlet direction D and the transversal line T is substantially equal, or equal, to the radius R. Thus, the outlet direction D is a tangential direction with respect to the axis x of rotation. The downstream point 21" is located at a shorter perpendicular distance P to the transversal line T than the outlet direction D.

The upstream portion 22 has a constant cross-section when seen in a section transversal to the axis x of rotation, as can be seen in FIG. 2. This means that the upstream portion 22 has upstream outlet walls 24, 25 that are parallel with each other, and with the outlet direction D. In particular, the upstream outlet wall 24 coincides with the outlet direction D.

In the embodiments disclosed, the upstream outlet walls 24, 25 are also parallel with the axis x of rotation.

The distance between the two upstream outlet walls 24 and 25 is shorter, or significantly shorter, than the length L, and the radius R.

The downstream portion 23 and has an increasing cross-section when seen in the section transversal to the axis x of rotation shown in FIG. 2. This means that the downstream portion 22 has downstream outlet walls 26, 27 that are diverging from each other.

The drainage outlet 19 is provided downstream the downstream portion 23 of the gas outlet 20 as illustrated in FIG. 2. The gas outlet 20 is thus configured to convey the liquid impurities, which have been separated from the gas, to the drainage outlet 19. The liquid impurities, which are illustrated as exaggerated spots in the figures, form a thin flow of separated oil, which is transported from the gaps 13 to an inner side of the side wall 3 due to the centrifugal force. The rotary movement conveys the separated oil along the inner side of the side wall 3 to the outlet opening 21 and the gas outlet 20. The separated oil is then conveyed outwardly on the upstream outlet walls 24, 25 and the downstream outlet walls 26, 27 to the drainage outlet 19.

At the drainage outlet 19 the separated oil may be recovered and taken care of in any suitable manner. In case of a combustion engine the separated oil may be returned to the oil system of the combustion engine. The separated oil may also be used for lubrication of the first and second bearings 11 and 12, at least the second bearing 12.

The cleaned gas may be discharged via the gas outlet 20 to an outlet conduit 28. The outlet conduit 28 may advantageously recirculate the cleaned gas, for instance to the inlet side of the combustion engine.

Figure 6:
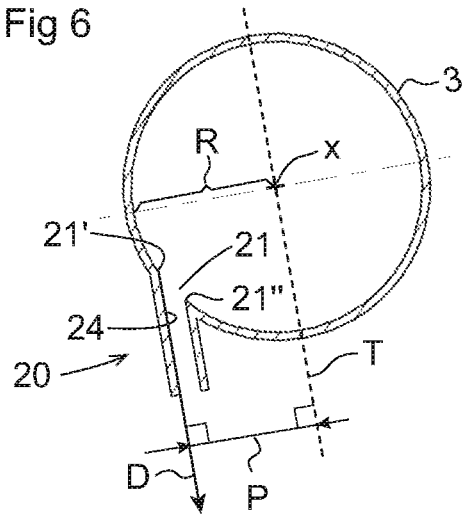
FIG. 6 illustrates the direction of the gas outlet of a centrifugal separator according to a second embodiment of the invention.
Figure 7:
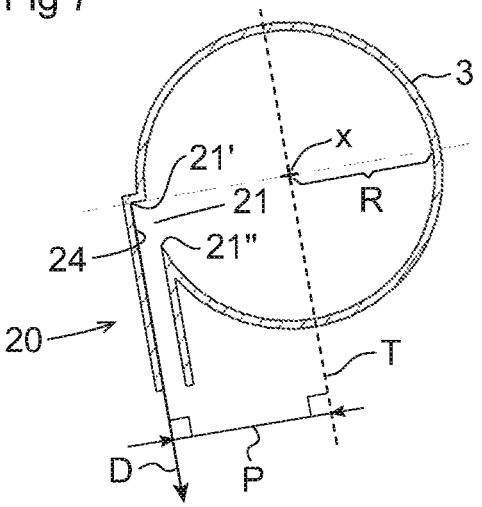
FIG. 7 illustrates the direction of the gas outlet of a centrifugal separator according to a third embodiment of the invention.
Figure 8:
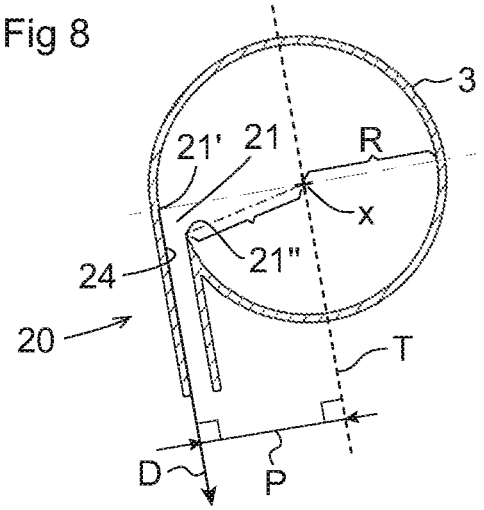
FIG. 8 illustrates the direction of the gas outlet of the centrifugal separator according to a fourth embodiment of the invention.

It is to be noted that the outlet direction D may have another extension than shown in FIGS. 1-5. FIGS. 6-8 disclose further embodiments, which differs from the first embodiment only with respect to the outlet direction D of the gas outlet 20.

FIG. 6 illustrates a second embodiment, in which the upstream point 21' forms a convex, or sharp convex, corner between the inner side of the side wall 3 and the upstream wall 24 forming an outer upstream wall. It should be noted that the corner may be rounded. The upstream outlet wall 24, which is parallel, or coincides, with the outlet direction D, is parallel with the transversal line T.

In the second embodiment, the perpendicular distance P between the outlet direction D and said transversal line T is shorter than the radius R and approximately 0.9R. The perpendicular distance between the transversal line T and the downstream point 21" is shorter than 0.9R.

FIG. 7 illustrates a third embodiment, in which the upstream point 21' is located at the end of a transition region between the inner side of the side wall 3 and the upstream outlet wall 24. The upstream outlet wall 24, which is parallel, or coincides, with the outlet direction D, is parallel with the transversal line T but located outside a tangential plane. The transition region may coincide with a radial line as shown in FIG. 7, configured as a line inclined with respect to a radial line, or as a smooth transition from the inner side of the side wall 3 to the upstream outlet wall 24 and the upstream point 21'.

In the third embodiment, the perpendicular distance P between the outlet direction D and the transversal line T is longer than the radius R and approximately 1.1R. The perpendicular distance between the transversal line T and the downstream point 21" is shorter than the radius R.

FIG. 8 illustrates a fourth embodiment, in which the upstream outlet wall 24 is parallel, or coincides, with the outlet direction D and the transversal line T. In the fourth embodiment the side wall 3 deviates from a cylindrical shape along a segment upstream the outlet opening 21.

In the fourth embodiment, the perpendicular distance P between the outlet direction D and the transversal line T is longer than the radius R and approximately 1.1R. The perpendicular distance between the transversal line T and the downstream point 21" may be longer than, equal to or as shown in FIG. 8 shorter than the radius R, which is approximately 0.9R.

The present invention is not limited to the embodiments disclosed, but may be varied and modified within the scope of the following claims.

What is claimed is:

1. A centrifugal separator for cleaning gas containing liquid impurities, the centrifugal separator comprising:

a stationary casing, enclosing a separation space through which a gas flow is permitted, the stationary casing comprising a surrounding side wall, a first end wall and a second end wall, an inlet extending through the stationary casing and permitting supply of the gas to be cleaned;

a rotating member comprising a stack of separation disks and being arranged to rotate around an axis of rotation;

a drive member, for rotating the rotating member;

a gas outlet configured to permit discharge of cleaned gas, and comprising an outlet opening through the side wall of the stationary casing; and a drainage outlet configured to permit discharge of liquid impurities separated from the gas to be cleaned, the drainage outlet surrounding the gas outlet.

2. The centrifugal separator according to claim 1, wherein the outlet opening has an elongated shape along a longitudinal axis.

3. The centrifugal separator according to claim 2, wherein the longitudinal axis has at least a major component of direction which is parallel with the axis of rotation.

4. The centrifugal separator according to claim 2, wherein the longitudinal axis is substantially parallel with the axis of rotation.

5. The centrifugal separator according to claim 1, wherein the stack of separation disks has an outer circumferential periphery and an axial length at the outer circumferential periphery, and wherein the outlet opening along the longitudinal axis has a length, wherein the length is 80-130% of the axial length.

6. The centrifugal separator according to claim 5, wherein the length is 90-120% of the axial length.

7. The centrifugal separator according to claim 5, wherein the length is 100-110% of the axial length.

8. The centrifugal separator according to claim 1, wherein the stationary casing has a radius from the axis of rotation to the surrounding side wall.

9. The centrifugal separator according to claim 8, wherein the gas outlet has an upstream portion, the upstream portion having an inner sidewall and an outer sidewall extending from the outlet opening in an outlet direction, which is parallel with a transversal line extending through the axis of rotation, the perpendicular distance between the outer sidewall and said transversal line is at least 0.8R and at the most 1.2R.

10. The centrifugal separator according to claim 9, wherein the perpendicular distance between the outlet direction and said transversal line is at least 0.9R and at the most 1.1R.

11. The centrifugal separator according to claim 10, wherein the perpendicular distance between the outlet direction and said transversal line is substantially equal, or equal, to the radius R.

12. The centrifugal separator according to claim 9, wherein the gas outlet has a downstream portion, which is provided downstream of the upstream portion and has an increasing cross-section in a direction extending from the upstream portion.

13. The centrifugal separator according to claim 12, wherein the downstream portion extends from the upstream portion.

14. The centrifugal separator according to claim 1, wherein the gas outlet is configured to convey the liquid impurities to the drainage outlet.

15. The centrifugal separator according to claim 12, wherein the drainage outlet is provided downstream of the downstream portion.

16. The centrifugal separator according to claim 1, wherein the separation disks are provided at a distance from each other to form a gap between adjacent separation disks.

17. The centrifugal separator according to claim 16, wherein the rotating member defines a central space, which is connected to the inlet and configured to convey the gas to be cleaned from the inlet to the gaps of the stack of separation disks.

* * * * *